US010563550B2

(12) United States Patent
Son et al.

(10) Patent No.: US 10,563,550 B2
(45) Date of Patent: Feb. 18, 2020

(54) VALVE DURATION CONTROL APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 1132 days.

(21) Appl. No.: 14/940,609

(22) Filed: Nov. 13, 2015

(65) Prior Publication Data

US 2016/0160704 A1 Jun. 9, 2016

(30) Foreign Application Priority Data

Dec. 9, 2014 (KR) ..... 10-2014-0175845

(51) Int. Cl.
*F01L 13/00* (2006.01)

(52) U.S. Cl.
CPC ... *F01L 13/0015* (2013.01); *F01L 2013/0084* (2013.01)

(58) Field of Classification Search
CPC ..... F01L 13/0015; F01L 2013/0084; F01L 2001/0473; F01L 1/34413; F01L 1/46; F01L 2013/0089; F02D 13/0215; F02D 13/0234; F02D 13/0249
USPC ..... 123/90.16, 90.15, 90.17, 90.27
See application file for complete search history.

(56) References Cited

U.S. PATENT DOCUMENTS

| | | | |
|---|---|---|---|
| 5,924,334 | A | 7/1999 | Hara et al. |
| 2013/0146006 | A1 | 6/2013 | Kim et al. |

FOREIGN PATENT DOCUMENTS

| | | | |
|---|---|---|---|
| CN | 102477879 | A | 5/2012 |
| CN | 103306776 | A | 9/2013 |
| JP | H 06-185321 | A | 7/1994 |
| JP | 2009-236010 | A | 10/2009 |
| KR | 10-2013-0063819 | A | 6/2013 |

*Primary Examiner* — Patrick Hamo
*Assistant Examiner* — Paul W Thiede
(74) *Attorney, Agent, or Firm* — Morgan, Lewis & Bockius LLP

(57) ABSTRACT

A continuous variable valve duration apparatus includes a camshaft, a plurality of wheels mounted to the camshaft, and a wheel pin, a plurality of cam portions of which a cam and a cam pin are formed thereto respectively, of which the camshaft is inserted thereto, and of which relative phase angle with respect to the camshaft is variable a plurality of inner brackets including a first pin guide hole and a second pin guide hole and a wheel pin connected to the wheel respectively and a cam pin connected to the cam respectively are slidably inserted into the first pin guide hole and the second pin guide hole respectively, a plurality of a slider housings of which the each inner bracket is rotatably inserted thereto respectively, and rotatably configured around a hinge hole formed a side of a cam cap and a control portion selectively moving the slider housings.

18 Claims, 5 Drawing Sheets

VALVE DURATION CONTROL APPARATUS AND ENGINE PROVIDED WITH THE SAME

CROSS-REFERENCE TO RELATED APPLICATION

The present application claims priority to and the benefit of Korean Patent Application No. 10-2014-0175845 filed on Dec. 9, 2014, the entire contents of which is incorporated herein for all purposes by this reference.

BACKGROUND OF THE INVENTION

Field of the Invention

The present invention relates to a continuous variable valve duration apparatus and an engine provided with the same. More particularly, the present invention relates to a continuous variable valve duration apparatus an engine provided with the same which may vary opening duration of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve duration apparatus and an engine provided with the same which may vary opening duration of a valve according to operation conditions of an engine, with a simple construction.

According to various aspects of the present invention, a continuous variable valve duration apparatus may include a camshaft, a plurality of wheels mounted to the camshaft, and of which a wheel pin is formed thereto respectively, a plurality of cam portions of which a cam and a cam pin are formed thereto respectively, of which the camshaft is inserted thereto, and of which relative phase angle with respect to the camshaft is variable, a plurality of inner brackets of which a first pin guide hole and a second pin guide hole are formed thereto and a wheel pin connected to the wheel respectively and a cam pin connected to the cam respectively are slidably inserted into the first pin guide hole and the second pin guide hole respectively, a plurality of a slider housings of which the each inner bracket is rotatably inserted thereto respectively, and rotatably configured around a hinge hole formed a side of a cam cap and a control portion selectively moving the slider housings so as to change relative position of a rotation center of the inner brackets.

The continuous variable valve duration apparatus may further include a bearing inserted between the slider housing and the inner bracket.

The slider housings may be integrally connected by a connecting bracket.

A guide slot may be formed to the connecting bracket and the control portion may include an eccentric control shaft inserted into the guide slot and a control motor selectively rotating the eccentric control shaft for controlling relative positions of the sliding housings.

A connecting hole may be formed to the connecting bracket and a connecting rod may be inserted into the connecting hole and the hinge hole for the connecting bracket to be rotatably connected with the cam cap.

The first hole and the second hole may be formed toward a center of the inner bracket.

The cam of the cam portion may be formed as a pair and a cam cap engaging portion may be formed between the cams for being connected with cam cap.

The cam cap may be disposed as plural and the cam caps may be integrally connected by a cam cap connecting rod.

The wheel may be connected with the camshaft through a connecting pin.

According to various aspects of the present invention, an engine may include a camshaft, a plurality of wheels mounted to the camshaft, of which a wheel pin is formed thereto respectively and disposed corresponding to each cylinder, a plurality of cam portions of which a cam and a cam pin are formed thereto respectively, of which the camshaft is inserted thereto, of which relative phase angle with respect to the camshaft is variable, and disposed corresponding to the each cylinder, a plurality of inner brackets of which a first pin guide hole and a second pin guide hole are formed thereto and a wheel pin connected to the wheel respectively and a cam pin connected to the cam respectively are slidably inserted into the first pin guide hole and the second pin guide hole respectively, a plurality of a slider housings of which the each inner bracket is rotatably inserted thereto respectively, and rotatably configured around a hinge hole formed a side of a cam cap and a control portion selectively moving the slider housings so as to change relative position of a rotation center of the inner brackets.

The engine may further include a bearing inserted between the slider housing and the inner bracket.

The slider housings may be integrally connected by a connecting bracket.

A guide slot may be formed to the connecting bracket and the control portion may include an eccentric control shaft inserted into the guide slot and a control motor selectively rotating the eccentric control shaft for controlling relative positions of the sliding housings.

A connecting hole may be formed to the connecting bracket and a connecting rod may be inserted into the connecting hole and the hinge hole for the connecting bracket to be rotatably connected with the cam cap.

The first hole and the second hole may be formed toward a center of the inner bracket.

The cam of the cam portion may be formed as a pair and a cam cap engaging portion may be formed between the cams for being connected with cam cap.

The cam cap may be disposed as plural and the cam caps may be integrally connected by a cam cap connecting rod.

The wheel may be connected with the camshaft through a connecting pin.

As described above, a continuous variable valve duration apparatus according to an exemplary embodiment of the present invention may vary an opening duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
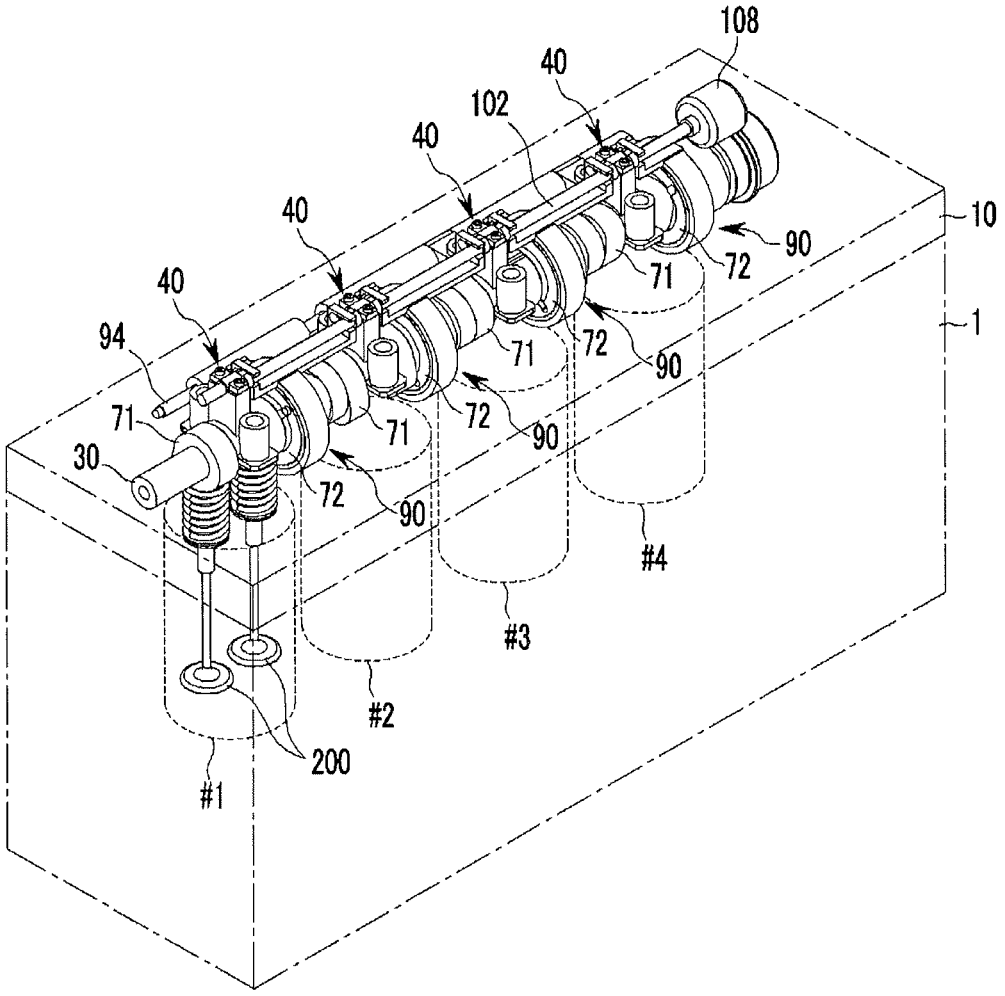
FIG. 1 is a perspective view of an engine provided with a continuous variable valve duration apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
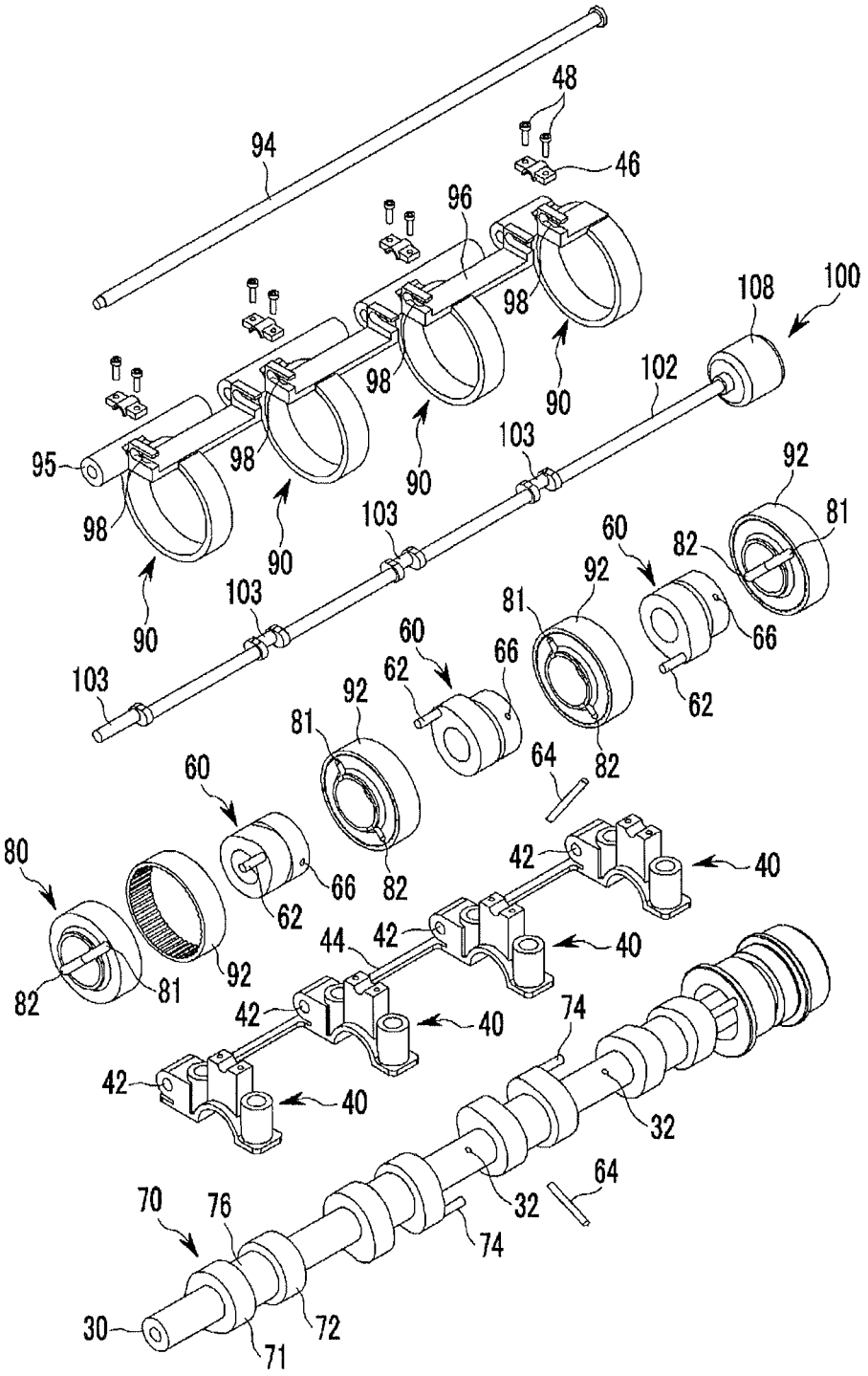
FIG. 2 is an exploded perspective view of a continuous variable valve duration apparatus according to an exemplary embodiment of the present invention.
Figure 3:
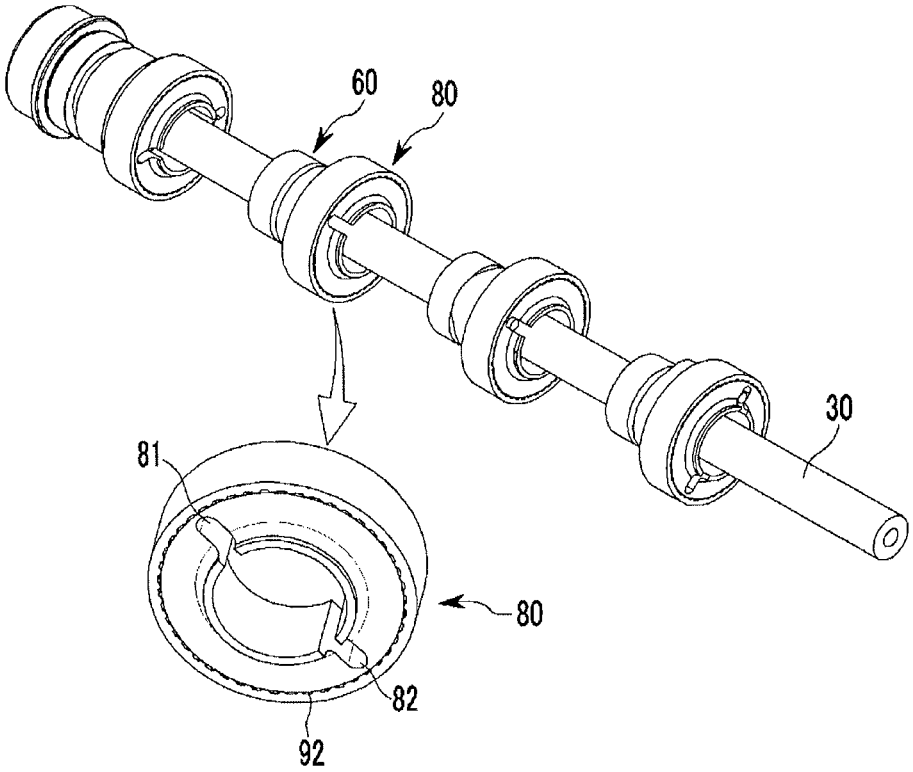
FIG. 3 is a perspective view of a camshaft applied to a continuous variable valve duration apparatus according to an exemplary embodiment of the present invention.

FIG. 1 is a perspective view of an engine provided with a continuous variable valve duration apparatus according to an exemplary embodiment of the present invention, FIG. 2 is an exploded perspective view of a continuous variable valve duration apparatus according to an exemplary embodiment of the present invention, and FIG. 3 is a perspective view of a camshaft applied to a continuous variable valve duration apparatus according to an exemplary embodiment of the present invention.

Referring to FIG. 1 to FIG. 3, an engine according to an exemplary embodiment of the present invention includes an engine block 1, and a cylinder head 10 disposed on the engine block 1 and a continuous variable valve duration apparatus mounted to the cylinder head 10.

The continuous variable valve duration apparatus includes a camshaft 30, a plurality of wheels 60 mounted to the camshaft 30, of which a wheel key 62 is formed thereto respectively, a plurality of cam portions 70 of which a cam 71 and/or 72 and a cam key 74 are formed thereto respectively, of which the camshaft 30 is inserted thereto, of which relative phase angle with respect to the camshaft 30 is variable, a plurality of inner brackets 80 of which a first pin guide hole 81 and a second pin guide hole 82 are formed thereto and a wheel pin 62 connected to the wheel 60 respectively and a cam pin 74 connected to the cam 71 and 72 respectively are slidably inserted into the first pin guide hole 81 and the second pin guide hole 82 respectively, a plurality of a slider housings 90 of which the each inner bracket 80 is rotatably inserted thereto respectively, and rotatably configured around a hinge hole 42 formed a side of a cam cap 40 and a control portion 100 selectively moving the slider housings 90 so as to change relative position of a rotation center of the inner brackets 80.

The camshaft 30 may be an intake camshaft or an exhaust camshaft.

The cam 71 and 72 is formed as a pair and a cam cap engaging portion 76 is formed between the cams 71 and 72 for engaged with the cam cap 40. Thus the cam portion 70 is stably supported by the cam cap 40.

The cams 71 and/or 72 contacts to open valve 200.

The engine includes a plurality of cylinders #1, #2, #3 and #4, and the plurality of wheels 60 and the plurality of the cam portions are disposed corresponding to the each cylinder #1, #2, #3 and #4 respectively.

In the drawing, 4 cylinders are formed to the engine, but it is not limited thereto.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

A camshaft connecting hole 32 is formed to the camshaft 30, a wheel hole 66 is formed to the wheel 60, and a connecting pin 64 is inserted into the camshaft connecting hole 32 and the wheel hole 66 for connecting the camshaft 30 with the wheel 60.

The first hole 81 and the second hole 82 are formed toward a center of the inner bracket 80 and the wheel pin 62 and cam pin 62 are slidably inserted into the first guide hole 81 and the second guide hole 82 respectively.

Since shapes of the first guide hole 81, the second guide hole 82, the wheel pin 62 and cam pin 62 are simple, thus productivity may be enhanced.

The slider housings 90 are connected each other through a connecting bracket 96. Thus rotation positions of the slider housings 90 are integrally controlled and stably assembled.

A guide slot 98 is formed to the connecting bracket 96 and the control portion 100 includes an eccentric control shaft 102 inserted into the guide slot 98 and a control motor 108 selectively rotating the eccentric control shaft 102 for controlling relative positions of the sliding housings 90.

A control rod 103 is formed to the control shaft 102 and is inserted into the guide slot 90.

A connecting hole 95 is formed to the connecting bracket 98 and a connecting rod 94 is inserted into the connecting hole 95 and the hinge hole 42 for the connecting bracket 98 to be rotatably connected with the cam cap 40.

The cam cap 40 is disposed as plural and the cam caps 40 are integrally connected by a cam cap connecting rod 44 thus the cam caps 40 may be stably connected to the cylinder head 10 and productivity may be enhanced.

The cam cap 40 is assembled with a cam cap cover 46 through bolts 48 and the cam cap engaging portion 76 may be rotatably mounted therebetween.

Figure 4:
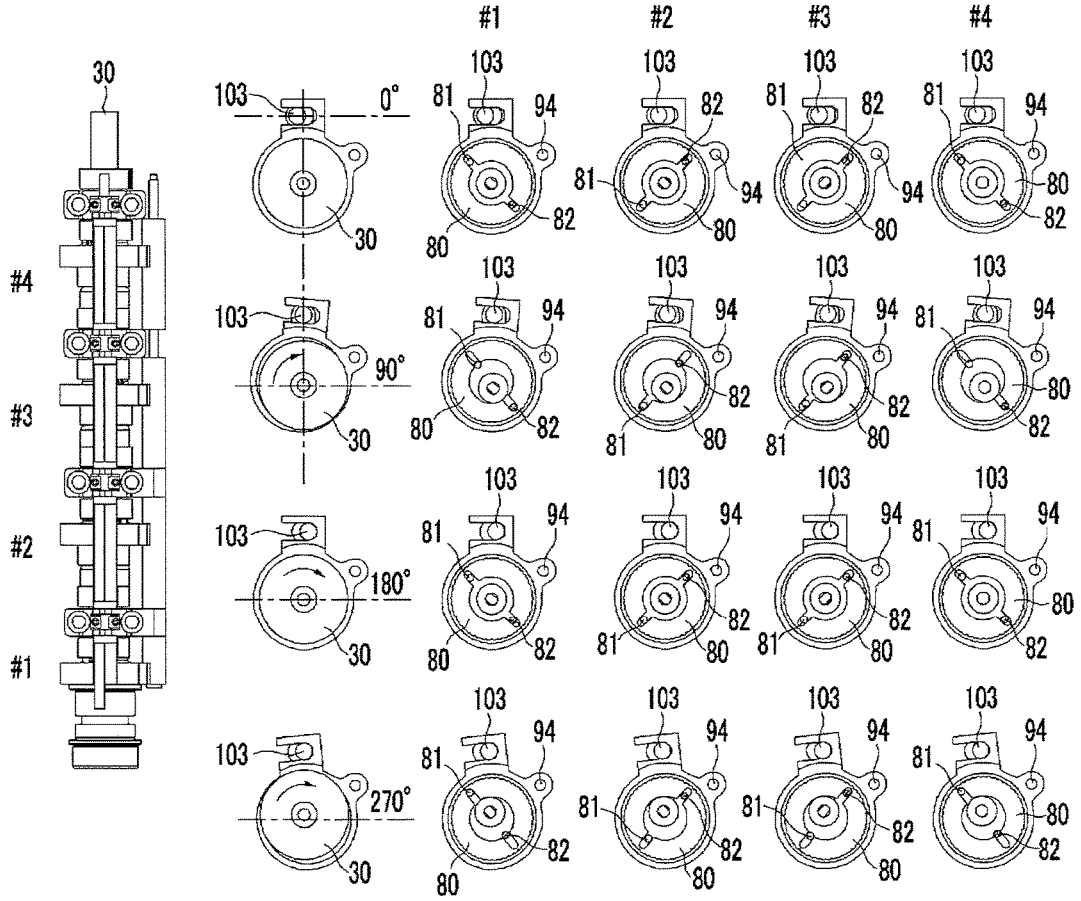
FIG. 4 is a drawing showing operations of a continuous variable valve duration apparatus according to an exemplary embodiment of the present invention.
Figure 5:
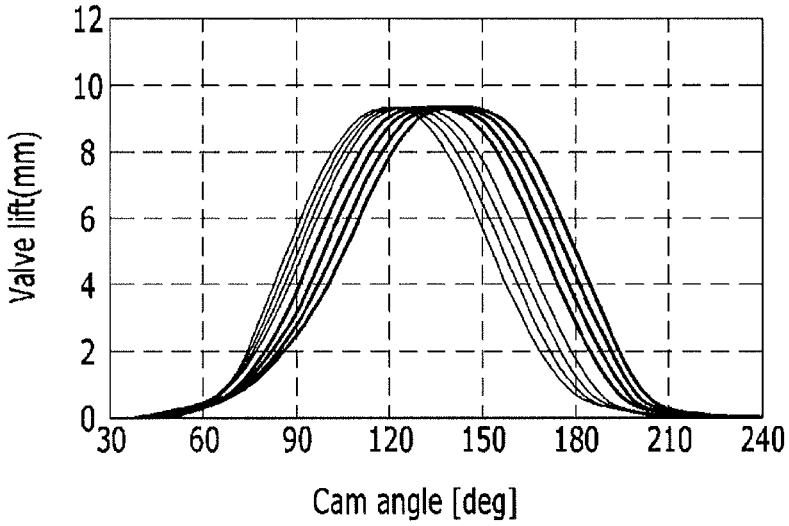
FIG. 5 is a graph of a valve profile of a continuous variable valve duration apparatus according to an exemplary embodiment of the present invention.

FIG. 4 is a drawing showing operations of a continuous variable valve duration apparatus according to an exemplary embodiment of the present invention, and FIG. 5 is a graph of a valve profile of a continuous variable valve duration apparatus according to an exemplary embodiment of the present invention.

Referring to FIG. 1 to FIG. 5, operations of the continuous variable valve duration apparatus according to various exemplary embodiment of the present invention will be described.

Each operation of the slider housing 90 and the inner bracket 80 disposed corresponding to 4 cylinders #1, #2, #3 and #4 is shown in FIG. 4.

Form up to bottom, phase angles of the eccentric control shaft 102 as 0°, 90°, 180° and 270° are shown sequentially.

For example, as phase angle of the eccentric control shaft 102 is 0°, the rotation center of the inner bracket 80 and the rotation center of the camshaft 30 coincide.

According to engine operation states, an ECU (engine control unit or electric control unit) transmits control signals to the motor 108 of the control portion 100 to change the relative position of the slider housing 90.

For example, as shown in FIG. 4, the eccentric control shaft 102 rotates according to the rotation of the control motor 108 around the hinge hole 42 (the connecting rod 94 inserted into the hinge hole 42), the rotation center of the inner bracket 80 with respect to the rotation center of the camshaft 30, and thus, angular acceleration of the cam portion 70 is changed so as that duration of the valves 200 is changed.

That is, as shown in FIG. 5, although maximum lift of the valve 200 is constant, however rotation speed of the cam 71 and 72 with respect to the rotation speed of the camshaft 30 is changed according to relative positions of the slider housing 90 so that duration of the valve 200 is changed and various valve profile may be performed.

As an example shown in FIG. 5, opening time of the valve 200 is constant and closing time of the valve 200 is controlled, however, it is not limited thereto. According to mounting angle of the valve 200 and so on, various valve durations may be performed.

As described above, a continuous variable valve duration apparatus according to an exemplary embodiment of the present invention may vary duration of a valve according to operation conditions of an engine, with a simple construction.

The continuous variable valve duration apparatus according to an exemplary embodiment of the present invention may be reduced in size and thus the entire height of a valve train may be reduced.

Since the continuous variable valve duration apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve duration control apparatus comprising:

a camshaft;

a plurality of wheel pins and a plurality of cam pins;

a plurality of wheels mounted to the camshaft, wherein each wheel includes a wheel pin;

a plurality of cam portions each including a cam and a cam pin, the camshaft being inserted through the plurality of cam portions so that a relative phase angle of each of the plurality of cam portions with respect to the camshaft is variable;

a plurality of inner brackets, where each inner bracket includes a first pin guide hole and a second pin guide hole, wherein each wheel pin of the plurality of wheel pins is connected to a corresponding wheel of the plurality of wheels and slidably inserted in to the corresponding first pin guide hole of the plurality of first pin guide holes, and wherein each cam pin of the plurality of cam pins is connected to the corresponding cam of the plurality of cams and inserted into the corresponding second pin guide hole of the plurality of second pin guide holes, the plurality of inner brackets respectively and rotatably inserted into a plurality of slider housings;

a plurality of cam caps each including a hinge hole, wherein the plurality of slider housings are respectively and rotatably mounted to the hinge hole of each cam cap of the plurality of cam caps; and a control portion moving the plurality of slider housings so as to change a position of a rotation center of the plurality of inner brackets relative to a rotation center of the camshaft.

2. The valve duration control apparatus of claim 1, further comprising a bearing inserted between each slider housing of the plurality of slider housings and the corresponding inner bracket of the plurality of inner brackets.

3. The valve duration control apparatus of claim 1, wherein the plurality of slider housings are respectively integrally connected together by a plurality of connecting brackets.

4. The valve duration control apparatus of claim 3, wherein a guide slot is formed to each of the plurality of connecting brackets; and wherein the control portion comprises:

an eccentric control shaft inserted into the guide slots; and a control motor rotating the eccentric control shaft for controlling a position of the plurality of sliding housings.

5. The valve duration control apparatus of claim 4, wherein a connecting hole is formed to each of the plurality of connecting brackets; and wherein a connecting rod is inserted into the connecting hole and the hinge hole for each of the plurality of connecting brackets to be rotatably connected with the plurality of cam caps.

6. The valve duration control apparatus of claim 1, wherein the first pin guide holes and the second pin guide holes each extend in the respective plurality of inner brackets along a radial direction of the plurality of inner brackets.

7. The valve duration control apparatus of claim 1, wherein the plurality of cams are formed as a pair of cams; and a cam cap engaging portion is formed between the pair of cams for being connected with the corresponding cam cap of the plurality of cam caps.

8. The valve duration control apparatus of claim 7, wherein the plurality of cam caps are respectively integrally connected by a cam cap connecting rod.

9. The valve duration control apparatus of claim 1, wherein the plurality of wheels are respectively connected with the camshaft by a respective connecting pin of a plurality of connecting pins.

10. An engine comprising:

a camshaft;

a plurality of cylinders;

a plurality of wheel pins and a plurality of cam pins;

a plurality of wheels mounted to the camshaft, wherein each wheel includes a wheel pin, the plurality of wheels being disposed corresponding to each cylinder of the plurality of cylinders;

a plurality of cam portions each including a cam and a cam pin, the camshaft being inserted through the plurality of cam portions so that a relative phase angle of each of the plurality of cam portions with respect to the camshaft is variable;

a plurality of inner brackets, wherein each inner bracket includes a first pin guide hole and a second pin guide hole, wherein each wheel pin of the plurality of wheel pins is connected to the corresponding wheel of the plurality of wheels and slidably inserted into the corresponding first pin guide hole of the plurality of first pin guide holes, and wherein each cam pin of the plurality of cam pins is connected to the corresponding cam of the plurality of cams and inserted into the corresponding second pin guide hole of the plurality of second pin guide holes, the plurality of inner brackets respectively and rotatably inserted into a plurality of slider housings;

a plurality of cam caps each including a hinge hole, wherein the plurality of slider housings are respectively and rotatably mounted to a hinge hole of each cam cap of the plurality of cam caps; and a control portion moving the plurality of slider housings so as to change a position of a rotation center of the plurality of inner brackets relative to a rotation center of the camshaft.

11. The valve duration control apparatus of claim 10, further comprising a bearing inserted between each slider housing of the plurality of slider housings and the corresponding inner bracket of the plurality of inner brackets.

12. The valve duration control apparatus of claim 10, wherein the plurality of slider housings are respectively integrally connected together by a plurality of connecting brackets.

13. The valve duration control apparatus of claim 12, wherein a guide slot is formed to each of the plurality of connecting brackets; and wherein the control portion comprises:

an eccentric control shaft inserted into the guide slots; and a control motor rotating the eccentric control shaft for controlling a position of the plurality of sliding housings.

14. The engine of claim 13, wherein a connecting hole is formed to each of the plurality of connecting brackets; and wherein a connecting rod is inserted into the connecting hole and the hinge hole for each of the plurality of connecting brackets to be rotatably connected with the plurality of cam caps.

15. The valve duration control apparatus of claim 10, wherein the first pin guide holes and the second pin guide holes each extend in the respective plurality of inner brackets along a radial direction of the plurality of inner brackets.

16. The valve duration control apparatus of claim 10, wherein the plurality of cams are formed as a pair of cams; and a cam cap engaging portion is formed between the pair of cams for being connected with the corresponding cam cap of the plurality of cam caps.

17. The valve duration control apparatus of claim 16, wherein the plurality of cam caps are respectively integrally connected by a cam cap connecting rod.

18. The valve duration control apparatus of claim 10, wherein the plurality of wheels are respectively connected with the camshaft by a respective connecting pin of a plurality of connecting pins.

5

* * * * *